United States Patent [19]

Hammonds et al.

[11] 4,082,043

[45] Apr. 4, 1978

[54] FABRICATED RAILWAY CAR TRUCK

[75] Inventors: James C. Hammonds; Jan D. Holt, both of St. Charles, Mo.

[73] Assignee: ACF Industries, Incorporated, New York, N.Y.

[21] Appl. No.: 519,976

[22] Filed: Nov. 1, 1974

Related U.S. Application Data

[63] Continuation-in-part of Ser. No. 447,823, Mar. 4, 1974, abandoned.

[51] Int. Cl.[2] ..... B61F 3/08; B61F 5/14; B61F 5/30; B61F 5/36

[52] U.S. Cl. ..... 105/182 R; 105/199 CB; 105/202; 105/208; 105/224 R; 105/224.1

[58] Field of Search ..... 105/182 R, 190, 199 CB, 105/202, 224.1, 224 R, 208; 308/138

[56] References Cited

U.S. PATENT DOCUMENTS

| | | | |
|---|---|---|---|
| 579,311 | 3/1897 | Anderson | 105/202 |
| 630,358 | 8/1899 | King | 308/138 |
| 710,673 | 10/1902 | Fassett | 308/226 |
| 717,060 | 12/1902 | Weimer | 105/182 R |
| 1,810,718 | 6/1931 | Lord | 105/199 CB |
| 1,821,296 | 9/1931 | Drenning | 105/190 R X |
| 1,994,304 | 3/1935 | Devlin | 105/202 X |
| 2,168,293 | 8/1939 | Kiesel, Jr. | 105/182 R |
| 2,233,540 | 3/1941 | Latshaw | 105/224.1 |
| 2,513,266 | 6/1950 | Laukus, Sr. | 105/182 R |
| 3,338,183 | 8/1967 | Boissier | 105/202 |

FOREIGN PATENT DOCUMENTS

| | | | |
|---|---|---|---|
| 545,995 | 3/1956 | Belgium | 105/202 |

*Primary Examiner*—L. J. Paperner
*Assistant Examiner*—Howard Beltran
*Attorney, Agent, or Firm*—Henry W. Cummings

[57] ABSTRACT

In a railway car truck a transverse member is provided including spaced sides and a member joining said sides to define a hollow portion having an open bottom such that the shear center is spaced upwardly from the neutral axis of the section. A truck center bearing is provided at about the mid portion of said transverse member which is located at about said shear center so that torsional deflection or twisting of the transverse member is avoided.

13 Claims, 21 Drawing Figures

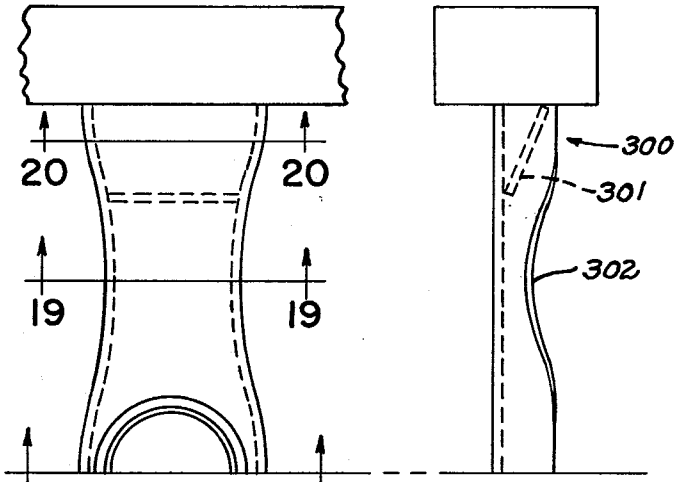
FIG. 17.
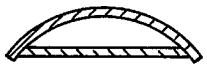
FIG. 20.
FIG. 16.
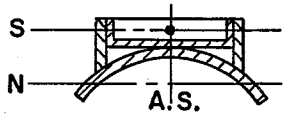
FIG. 18.
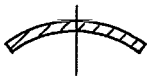
FIG. 19.
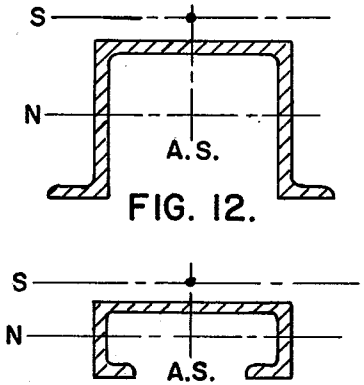
FIG. 12.
FIG. 12A.
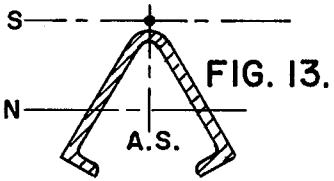
FIG. 13.
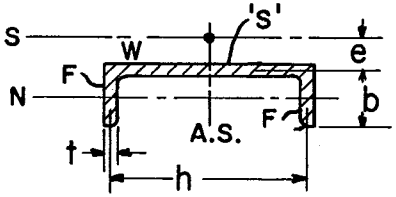
FIG. 14.
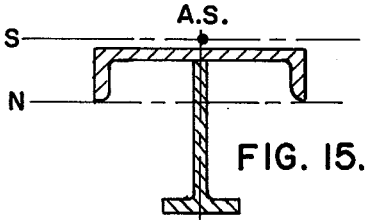
FIG. 15.
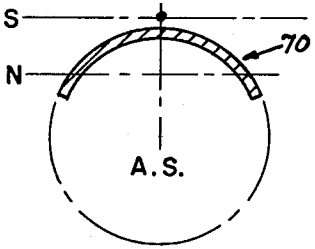
FIG. 8.
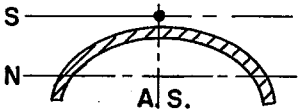
FIG. 9.
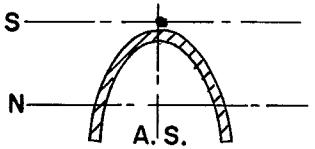
FIG. 10.
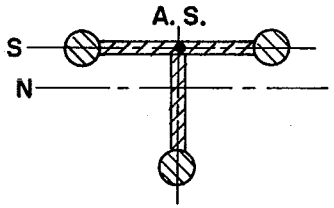
FIG. 11.

FABRICATED RAILWAY CAR TRUCK

CROSS REFERENCE TO RELATED APPLICATION

This application is a continuation-in-part of application Ser. No. 447,823 filed Mar. 4, 1974, now abandoned.

BACKGROUND OF THE INVENTION

One of the problems which is encountered with the conventionally used railway car trucks is the rock and roll encountered due at least in part to the staggered rail joints generally used in the U.S.

Another problem is that of hunting or the tendency of the truck to oscillate resonantly about the center plate of the car body, due to dynamic instability.

It is preferred to solve the problems of rock and roll and hunting with a construction wherein the static height of the truck between empty and full loads is not too great and preferably not greater than about 2½ inches. It further is desired that the railway car truck be capable of utilizing a standard wheel base, a standard center plate, and standard brakes.

SUMMARY OF THE INVENTION

It is an object of the present invention to reduce or eliminate rock and roll commonly occurring in conventional railway car trucks.

Another object of the present invention is to increase the speed at which the instability that results in hunting occurs to a speed beyond the usual maximum operating speed of freight trains.

Another object of the present invention is to provide a truck which reduces wheel flange wear.

Another object of the present invention is to provide a truck having a standard wheel base.

Another object of the present invention is to provide a railway car truck in which the car may utilize standard brakes.

Another object of the present invention is to provide a railway car truck which can utilize a standard center plate.

Another object of the present invention is to reduce or eliminate the problem of car center plate failures which is presently commonly occurring.

Another object of the present invention is to provide a railway car truck wherein the difference in the static height of the truck between empty and fully loaded car is not too great.

Another object of the present invention is to provide a truck design which will allow the attachment of an interface between the car body and truck of a sufficient area to transmit longitudinal loads between the car body and truck without inducing substantial torsional deflections into the transverse member.

In a railway car truck a transverse member is provided including spaced sides and a member joining said sides to define a hollow portion having an open bottom such that the shear center of the section is spaced upwardly from the neutral axis of the section. A truck center bearing is provided at about the mid portion of said transverse member which is located at about said shear center so that torsional deflection or twisting of the transverse member is avoided. Sufficient vertical surface area is provided in the truck center bearing to transmit horizontal loads radially between the car body and the truck. The transverse member is rigidly connected to the side frames to define in plan an integral H frame. The weight of the car body is taken at the mid portion of the spaced side frames. Low friction side bearings are provided on the side frames to allow the truck to rotate with respect to the car body as curves are traversed. It is believed that the rigid H frame is the reason that truck hunting is avoided up to at least about 80 miles per hour. Rock and roll of the truck may be controlled by resilient devices which mount the side frames on the journal boxes, and dampening devices which damp oscillations of the resilient devices.

THE DRAWINGS

FIG. 8 is a view of a circular cross section sector transverse member;

FIG. 9 is a view of a transverse member of an elliptical sector cross section;

FIG. 10 is a view of a transverse member having a parabolic sector cross section;

FIG. 11 is a view of a transverse member having a rod reinforced T section;

FIG. 12 is a view of a transverse member having an outwardly extending flanged channel section;

FIG. 12A is a view of a transverse member having an inwardly extending flanged channel section;

FIG. 13 is a view of a transverse member having a triangular apex section;

FIG. 14 is a view of a transverse member having a channel section;

FIG. 15 is a combination channel and inverted T section;

FIG. 16 is a view of a transverse member having a varying cross section;

FIG. 17 is a side elevational view of the transverse member shown in FIG. 16;

FIG. 18 is a view along the lines 18—18 in FIG. 16;

FIG. 19 is a view along the line 19—19 in FIG. 16; and

FIG. 20 is a view along the line 20—20 in FIG. 16.

DETAILED DESCRIPTION

Figure 1:
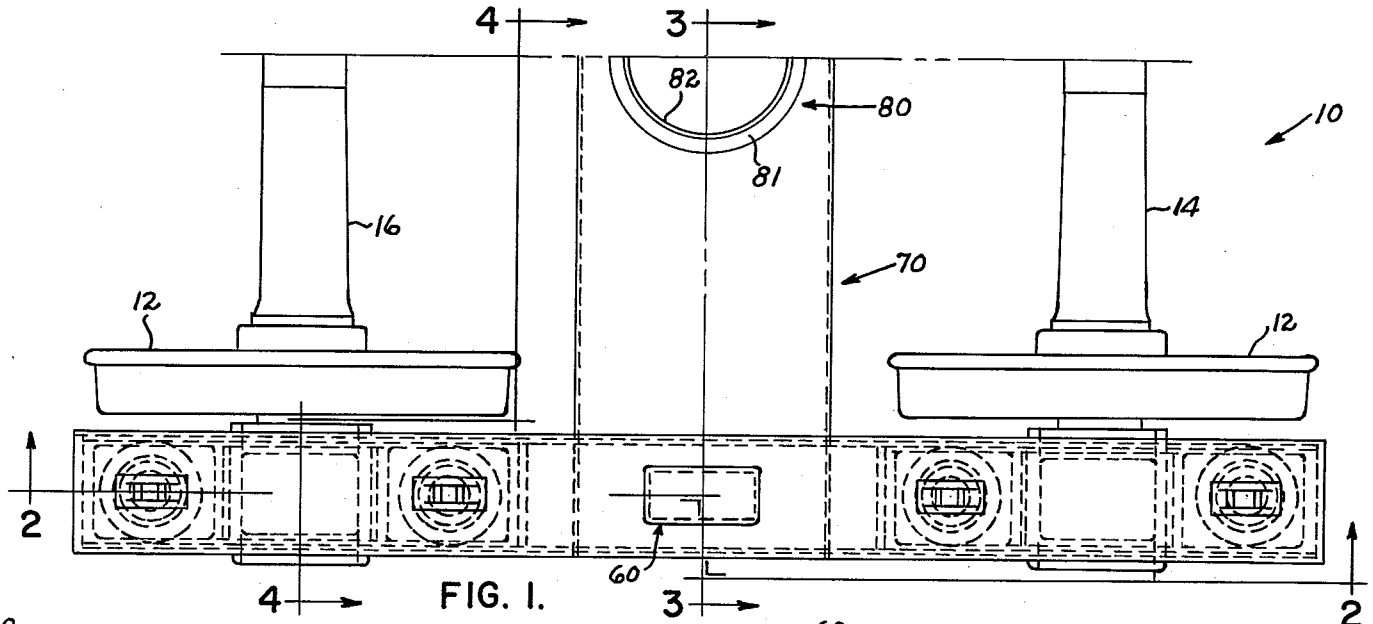
FIG. 1 is a top view of one embodiment of the railway car truck according to the present invention.
Figure 2:
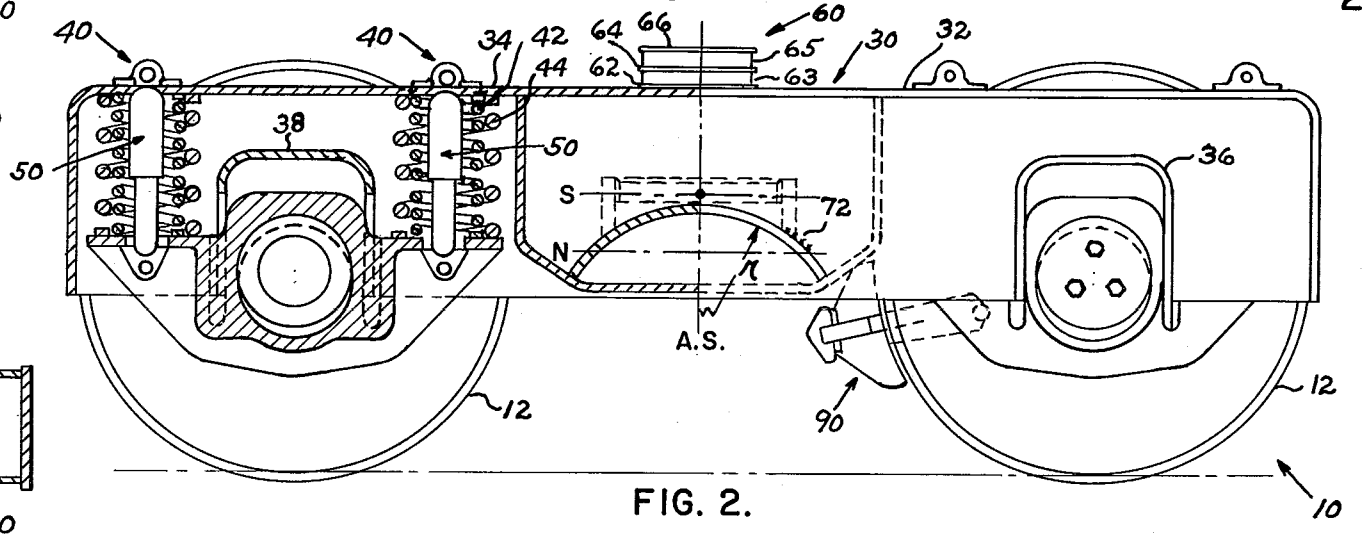
FIG. 2 is a view of the railway car truck partly in section along the lines 2—2 in FIG. 1.
Figure 3:
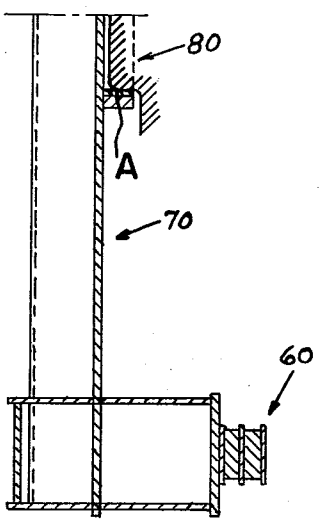
FIG. 3 is a sectional view along the line 3—3 in FIG. 1.
Figure 4:
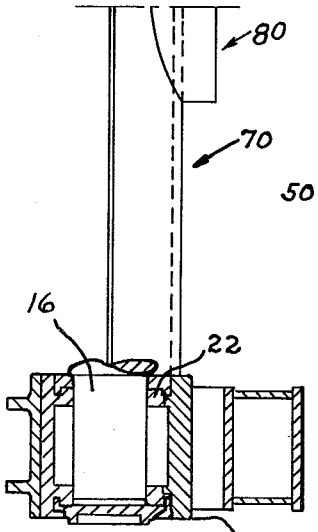
FIG. 4 is a sectional view along the line 4—4 in FIG. 1.

In accordance with the embodiment of the present invention shown in FIGS. 1-4 of the drawings, a railway car truck indicated generally at 10 is provided having four wheels, two of which are illustrated in FIG. 2 at 12. The wheels 12 are connected by axles 14 and 16 in the conventional manner. As shown in FIG. 4, the axles 14 and 16 are appropriately journalled in journal boxes 20 by means of appropriate bearings of conventional construction 22.

Mounted upon journal boxes 20 are longitudinally extending side frames indicated generally at 30. Side frames 30 comprise fore-and-aft portions 32 and 34 each having appropriate pedestals or cradles 36 and 38 allowing the side frames to rock back and forth upon journal boxes 20. The side frames preferably comprise spaced generally vertical outer and inner plates 35 and 37.

Appropriate resilient devices indicated generally at 40 may be provided to suspend the side frames about the journal boxes. Resilient devices 40 may comprise coil springs 42 and 44 illustrated in FIG. 2, or they may comprise leaf springs, rubber-in-shear springs, rubber-in-compression springs, and combination rubber-in-shear and compression (142 in FIG. 6) which may include V-shaped shims to control lateral spring rates, or any other appropriate resilient means to suspend the side frames from the journal boxes. This location of springing reduces the unsprung weight which results in a generally better ride and tends to isolate the truck parts from rail shock. The spring rate and the total travel of the spring is preferably similar to that used on conventional trucks (about 3 11/16 inches spring travel) in order to retain generally the same coupler height relationship as is now seen in service.

Figure 5:
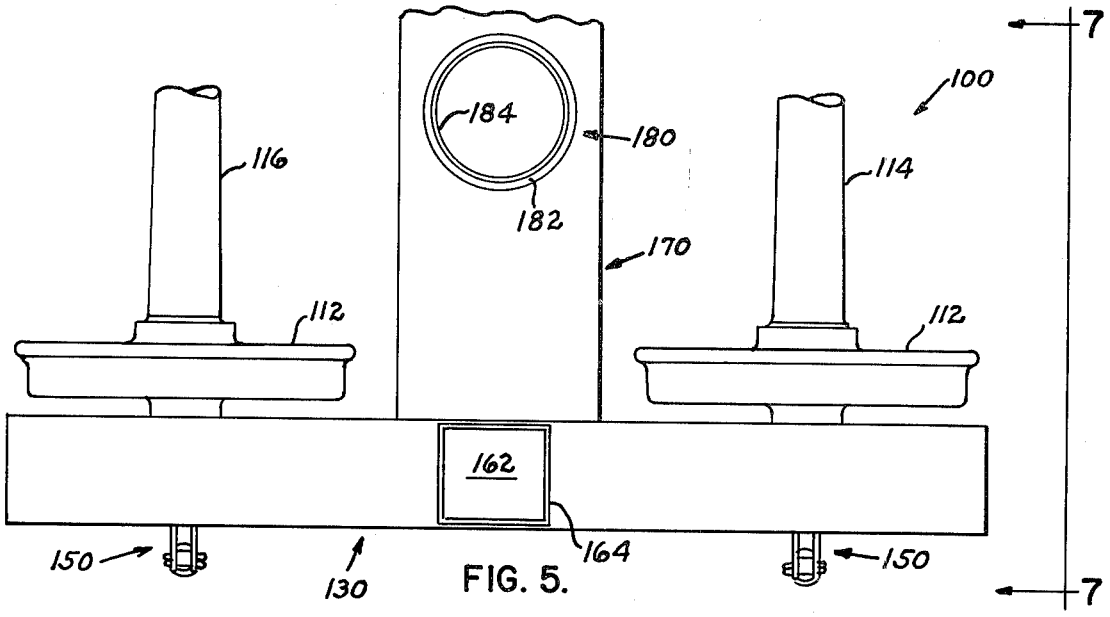
FIG. 5 is a top view of another embodiment of the present invention.
Figure 6:
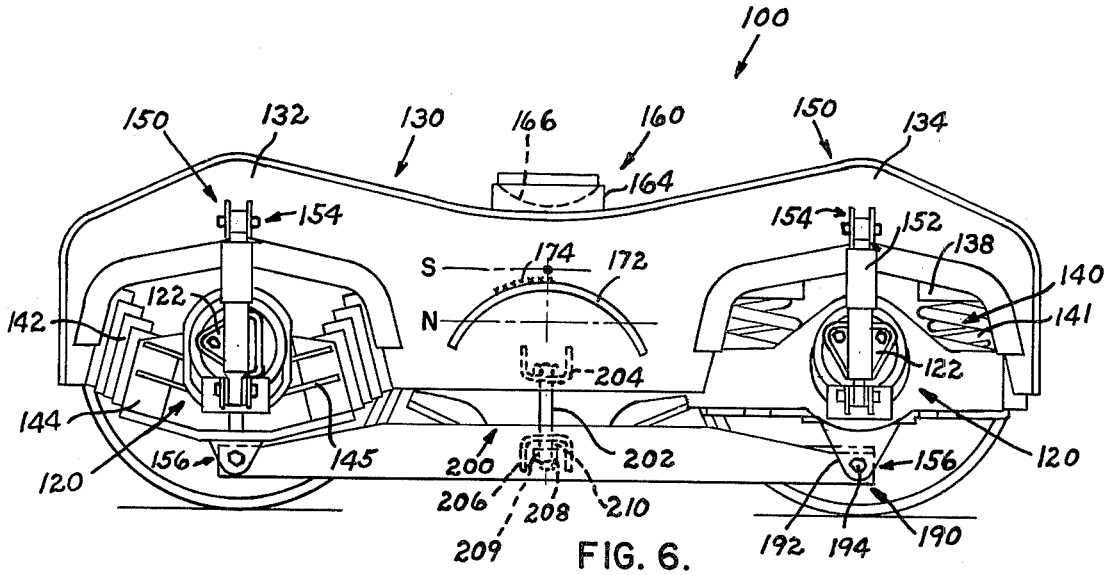
FIG. 6 is a side view of two embodiments of the present invention.

If desired, appropriate damping devices indicated generally at 50 may be provided for one or more of the resilient devices 40. The damping devices 50 may comprise any of the known shock absorbing constructions. For example, the damping devices may be hydraulic in nature, pneumatic, or they may operate on a friction principle. Damping devices 50 may be mounted within the resilient devices 40 as shown in FIGS. 1 and 2 or alternatively, they may be mounted outside as shown in FIGS. 5 and 6. The damping devices tend to reduce the vibration roll of the car. Preferably non-linear springs such as hydraulic or pneumatic units are used in order to provide velocity sensitive snubbing in which quick, hard impulses from the wheels are resisted at a higher rate than are gentle rolling motions.

The weight of the car body is taken at about the midpoint of the side frames by means of side bearings or blocks indicated generally at 60. The blocks allow the truck to swivel about the truck center pin while providing support for the car. In one embodiment the blocks are curved on one side to allow the bearing to tilt with the truck frame. The blocks are preferably made of an unlubricated, low-friction material. Various low-friction materials can be used.

Hunting is reduced by the integral H frame construction which increases the speed at which the instability that results in hunting occurs to a speed beyond the usual maximum operating speed of freight trains, preferably to a speed of at least about 80 miles per hour. It is believed the truck will resist hunting at speeds of up to about 100 miles per hour, or higher.

Truck hunting tendencies are further decreased by the constant friction damping that the bearing blocks provide. Side bearing blocks 60 may comprise a metal-polymeric lamina as indicated at FIGS. 1 and 2 having metal layers 62, 64, 66 and polymeric layers 63 and 65. Alternatively, as shown in FIGS. 5 and 6 the side bearing may comprise an essentially all polymeric block. Side bearings 60 must have sufficient compressive strength to with stand the weight of the vehicle body and transfer the same to the side frames 30. Preferably, the compressive strength is about 200 to 800 psi. At the same time the coefficient of friction of the blocks must be such that car body extensions may readily slide back and forth thereon when the truck goes around curves, and tending to damp the oscillating rotation which occurs during hunting. The coefficient of friction for these bearing blocks is preferably about 0.05 to 0.15. Furthermore, the side bearing 60 must have sufficient shear strength to withstand the shear load imparted during the back and forth movements of the vehicle body over the upper surface of member 60. Preferably the shear strength is at least 250 psi. In one embodiment blocks 60 have the capability of rocking longitudinally and transversely. For this embodiment polymeric blocks or polymeric laminate blocks are preferred.

In accordance with another embodiment a filled polytetrafluoro ethylene (TFE) material is utilized on the upper surface of blocks 60. Preferably a low friction material such as a filled nylon is used on the lower surface of the car body. The filled TFE and filled nylon result in a coefficient of friction not greater than about 0.12.

A particularly important feature of the present invention is the transverse member indicated generally at 70. The transverse member 70 is appropriately affixed to the side frames 30. This may be done with heavy duty mechanical fasteners, but preferably this is done by welding as indicated at 72. It will be apparent that the two side frames 30 and the transverse member 70 define an integral H-frame in plan. This construction tends essentially to retain its configuration at all times causing the axles to remain parallel and square with the truck frame. As mentioned above, the rigid "H" design tends to reduce the wheel flange wear. The "H" design together with the compression friction members inhibits hunting by raising the critical hunting speed to above those speeds commonly used in the railroad industry, preferably above about 80 miles per hour and most preferably above about 100 miles per hour. While this H-frame is relatively rigid in terms of withstanding bending moments applied longitudinally to the side frames, the transverse member does have torsional flexibility to withstand rocking movement of one side frame with respect to the other side frame. Thus the transverse member allows rotation of the side frames relative to one another while retaining the "H" frame configuration. Relatively free rotation of the frames allows the truck to distribute the car weight generally evenly to each wheel as the wheels roll over uneven track. Preferably the reduction in static wheel load is less than 15% for a one inch drop of one wheel on an empty car fitted with the truck of the present invention. Preferably, the approximate torsional flexibility is from 25,000 to 100,000 inch pounds of moment per degree. This torsional flexibility is most readily obtained in an open cross section including a pair of sides and a member joining said sides to define a hollow portion having an open bottom. Thus the torsionally flexible transverse member comprises a generally open section in order to provide bending strength in combination with torsional flexibility. Thus the open section may be curved, for example, a segment of circular (FIGS. 2, 6 and 8) or elliptical (FIG. 9), or parabolic (FIG. 10). The open section also may be non-curved, for example, channel-shaped, as shown in FIG. 14, triangular apex (FIG. 13), outward flanged channel section (FIG. 12), inward flanged channel (FIG. 12A), combination channel and inverted T (FIG. 15), and rod reinforced T section (FIG. 11). By way of example, if channel-shaped, the horizontal to vertical dimension ratio is preferably from 1 to 3. If circular, the radius of curvature is preferably 10 to 15 inches. If elliptical, the X/Y ratio is preferably 2.5 to 4.

In accordance with one embodiment of the invention, the shear center (S in the drawings) of the open section is spaced from the neutral axis of the open section (N in the drawings) a distance sufficient to allow the attachment of an interface between the car body and truck of a sufficient interface area to transmit longitudinal loads to the transverse member without inducing substantial torsional loads. Preferably the interface is wear resistant. Preferably, the shear center is located on the axis of symmetry (A.S. in the drawings). Thus, for example, if it be assumed in FIGS. 2 and 6, that the circular segment is a semicircle, the shear center S is spaced from the neutral axis N a distance of $4r/\pi$ for a circular segment of radius $r$. For a channel section (FIG. 14) the distance from surface S is equal to $h^2b^2 t/4 I$ where $h$ is the distance between the centers of the flanges F, $b$ is the distance from flange end to the center of longitudinal web W, $t$ is the flange thickness, and I is the moment of inertia about the neutral axis N.

The equation for the shear center for the other shapes shown is known in the art, see for example, page 110 of Advance Mechanics of Materials by Seely & Smith; Copyright 1952, Library of Congress #52-11034, John & Wiley & Sons, Inc. The other shapes shown may be appropriately dimensioned so that the shear center will fall outside the neutral axis (except for the rod reinforced T section shown in FIG. 11).

Transverse member 70 further comprises a center bearing indicated generally at 80. The center bearing at 80, for example, may comprise a conventional center plate 81 which, if desired, may be provided with a liner 82, for example, made of manganese steel. Center bearing 80 also may comprise any of the known resilient connections between the car body and truck.

The interface area between the car body and truck (A in FIG. 3) required for 70 to 125 ton railway trucks is approximately 48 to 60 square inches (14 inches and 16 inches center plate, respectively X 1⅛ inches vertical surface). Thus standard center plates may be used even when the shear center is spaced from the neutral axis and is located on the axis of symmetry.

By taking the weight of the car body at the side frames, the problem of cracking and/or breaking center plates encountered with trucks taking the weight of the vehicle at the center plate, is largely eliminated. Further center plate wear is reduced since hunting is reduced.

Furthermore, the cross section of the transverse member in accordance with the present invention may vary. For example, a varying cross section is shown in FIGS. 18–20. The circular sector is reduced in height as shown at 302 in FIG. 17 and the longitudinal extent of this sector varies as can be seen from a comparison of FIGS. 18 and 19. Even with a varying cross section, if desired, the shear center may be located outside the section, and, if desired, on the axis of symmetry, as shown in FIG. 18.

In accordance with one embodiment slots are provided in at least one and preferably both of the inner and outer generally vertical side frame members to facilitate welding the transverse member to the side frames. Thus slots 35*a* and 27*a* are preferably provided for this purpose.

Furthermore, reinforcements indicated generally at 300 are provided as shown in FIGS. 17 and 20 at the jointure of the transverse member and side frames. The reinforcements may comprise, for example, inclined plates 301 welded to the transverse member and side frames.

The truck of the present invention is preferably designed so that the weight on the wheel is equal to or greater than the force on the flange, to avoid derailment. Therefore the hereinbefore described torsional flexibility must be related to the spring rate of resilient devices 40 and to some extent to the damping coefficient of damping devices 50. It is preferred that the damping of damping devices 50 be from about 5 to 15% of critical damping (in the vertical direction). For linear springs it is preferred that the spring rate of resilient devices 40 be from 40,000 to 70,000 pounds per inch per truck. This spring rate further ensures that the static height between empty and full loads is not above about 2½ inches. However, if desired non-linear springs may be utilized if they maintain the desired range of static deflection.

It is also preferred that the truck of the present invention be so dimensioned as to have a standard wheel base and able to utilize standard brakes indicated generally in FIG. 2 at 90.

Longitudinal loads are transmitted between the car body and truck through center bearings 80 and 180 (FIG. 5). Impact loads are applied to the couplers, to car body and then to the transverse member radially through the car body-truck center bearing interfaces 80 and 180. Longitudinal braking loads are transmitted to the truck and then radially into the car body through the car body-center bearing interfaces 80 and 180.

Figure 7:
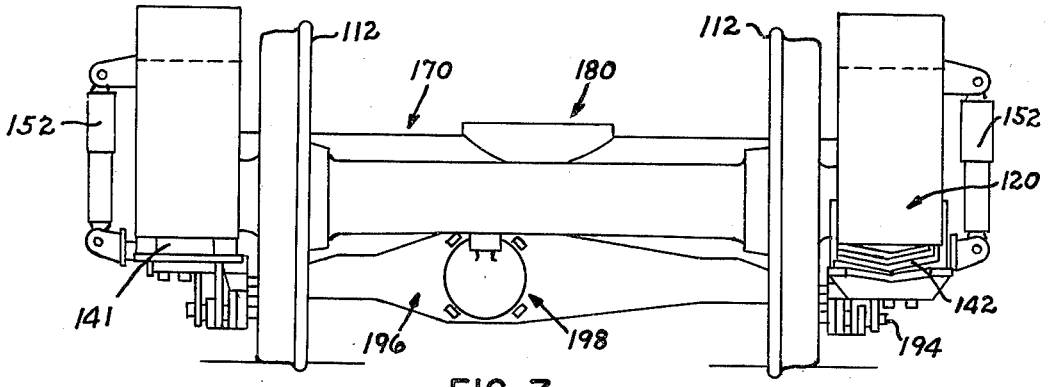
FIG. 7 is a front view along the line 7—7 in FIG. 5.

In accordance with another embodiment of the present invention shown in FIGS. 5–7 of the drawings, a fabricated railway car truck is indicated generally at 100. As was the case with the embodiment shown in FIGS. 1–4 of the drawings, the truck is provided with conventional wheels 112 and longitudinally spaced wheel axles 114 and 116. Axles 114 and 116 are journalled in journal boxes 120 of known construction by means of bearings of known construction 122.

Side frames indicated generally at 130 comprise fore-and-aft portions 132 and 134 and outside and inside plates 135 and 137 are adapted to be mounted about journal boxes 120. Side frames 130 are suspended about journal boxes 120 by means of resilient devices 140. As mentioned hereinbefore, resilient devices 140 may comprise linear or non-linear springs, including coil springs, rubber-in-shear springs, leaf springs, or rubber-in-compression springs. In FIG. 6 coil springs are illustrated at 140 and rubber-in-shear and compression springs at 142, although in general all springs on the truck would be of the same type. Bearing blocks 138 are preferably provided on the side frames if coil springs 141 are to be used. On the other hand, if rubber-in-shear and compression springs 142 are to be utilized as illustrated in the left hand portion of FIG. 6, the plates 144 are preferably provided affixed to journal boxes 120. If desired, plates 144 may be provided with support reinforcing gussets 145.

The fabricated truck is also preferably provided with damping devices indicated generally at 150. As illustrated in this embodiment, the damping devices comprise hydraulic shock absorbers indicated at 152 affixed to the side frames as indicated at 154 and to the journal box as indicated at 156 by appropriate, for example, brackets 158 and/or fasteners, preferably the mechanical fasteners are relatively removable to permit easy replacement of the damping devices. The damping devices preferably provide damping within the hereinbefore mentioned range of about 5 to 15% of critical damping.

Mounted at about the mid-point of the side frames is a side bearing indicated generally at 160. In accordance with the embodiment shown in FIGS. 5 and 6, the side bearing comprises a block 162 mounted within a suitable support or housing 164. As was mentioned in connection with the embodiment shown in FIGS. 1–4 of the drawings, the block must have a coefficient of friction sufficiently low to allow the car body to rotate back and forth thereon, while at the same time high to damp oscillations of the truck with respect to the car body. Furthermore, the block must have sufficient compression strength to take the weight of the car body thereon and sufficient shear strength to take the shear loads when the car body is rotating back and forth thereon. The block preferably should also have the capability of rocking longitudinally and transversely. In accordance with one embodiment, the block and housing are curved as indicated at 166, preferably partly cylindrical, most preferably partly spherical to allow the bearing to tilt with the truck frame.

The material for block 162 may be of any of the inorganic or polymeric materials which provide the hereinbefore mentioned properties. Examples of inorganic materials include carbon materials, particularly graphite. Examples of polymeric materials include polypropylene, polystyrene, nylon, and halogenated polymers, such as TFE. If desired, appropriate fillers and/or strengtheners may be used therein.

If desired, the material for housing 164 may be reinforced plastic or metallic, for example, steel, or stainless steel.

The transverse member of the integral H frame is indicated generally in FIGS. 5–7 at 170. In this embodiment the transverse member comprises a semi-circular segment as indicated in FIG. 6 at 172. The transverse member may be affixed to the side frames 130 by appropriate mechanical fasteners. However, most preferably, this is done by welding the transverse member in slots 135*a* in side frame plates 135, 137 and 137*a* as indicated in FIG. 6 at 174 and 175. As mentioned hereinbefore, transverse member 170 should be relatively rigid to maintain the H frame integral and to maintain it square to avoid hunting at common freight train speeds, preferably below about 80 miles per hour, and most preferably below about 100 miles per hour or higher. At the same time the transverse member should have sufficient torsional flexibility sufficient to allow side frame members 130 to rock back and forth in the event of uneven track.

Transverse member 170 is provided with an appropriate center bearing to the car body indicated generally at 180. This may comprise, for example, a conventional center plate 182 having mounted therein an appropriate center plate liner 184 of known construction, for example, made of manganese steel. As mentioned above, the problem of cracking and/or breaking center plates is largely reduced or eliminated by taking the car body weight on the side frames, and reducing hunting which reduces mating center plate wear.

Mounted upon journal boxes 120 are generally longitudinally extending brake beam supports indicated generally at 190. Brake beam supports 190 are preferably affixed to the journal boxes by appropriate mechanical fasteners, for example, including brackets 192 and bolts 194. Brake beam supports 190 support a transversely extending brake beam indicated generally at 196 in FIG. 7 having mounted therein a brake cylinder of known construction indicated generally at 198 adapted to apply braking forces to wheels 112 when properly actuated by the brake cylinder in a known manner.

If desired, a connection between brake beam supports 190 and the side frames may be provided as indicated generally at 200 in FIG. 6. This may comprise a vertically extending bolt 202 mounted upon suitable brackets or other supports in the side frames and brake beam supports as indicated, respectively, at 204 and 206. A nut 208 may be utilized in cooperation with thread 209 to provide a gap 210. The brake beam supports 190 provide a foundation for the brake system which does not move significantly relative to the wheels. Assembly 200 retains the wheels, side frames and brake system as a single assembly so that this assembly will remain intact during derailment or when the truck is lifted, for example, for maintenance. Space or gap 210 is provided to assure that the resilient devices are not under compression at their neutral positions.

It will therefore be apparent that the rock and roll commonly encountered in the trucks of the prior art due to the staggered rail joints used generally in the U.S. is reduced or eliminated by means of the transversely spaced side frames upon which the vertical load from the car body is directly applied, and the improved damping system.

Furthermore, truck hunting is largely reduced or eliminated by means of the integral H frame construction and the side bearing blocks mounted on the side frames. Additionally, the spring rate of the linear or non linear resilient devices at the journal boxes is such that the difference in static height between empty and full loads is not greater than about 2½ inches.

If desired, a standard wheel base, and/or standard brakes, and/or standard center plate may be used on the railway car truck of the present invention. As mentioned above, center plate cracking and/or breaking is largely eliminated by taking the car body weight at the side frames, and by the reduction in center plate wear.

The truck is intended primarily for freight service. However, the truck's improved riding characteristics may make the truck useful for passenger service as well.

What is claimed is:

1. A transverse member for a railway car truck adapted to be located between spaced side frames of said truck; said transverse member being elongated and having a cross section including a pair of longitudinally extending sides and a member joining said sides defining a hollow portion having an open bottom such that the shear center of said cross section is spaced upwardly from the neutral axis of said cross section throughout its length; a center bearing located at about the mid portion of said transverse member at about said shear center for receiving a cooperating car body center connection of a railway car body; said center bearing having sufficient vertical surface area to transmit horizontal loads radially between the car body and said truck; said center bearing being spaced upwardly from said neutral axis a distance sufficient to prevent substantial torsional deflection of said transverse member.

2. A transverse member according to claim 1 wherein said shear center is located on the axis of symmetry.

3. A transverse member according to claim 2 wherein said transverse member comprises a circular segment cross section.

4. A transverse member according to claim 2 wherein said transverse member comprises an elliptical segment cross section.

5. A transverse member according to claim 2 wherein said transverse member comprises a parabolic segment cross section.

6. A transverse member according to claim 2 wherein said transverse member comprises a channel shaped cross section.

7. A transverse member according to claim 2 wherein said transverse member comprises a flanged channel cross section.

8. A transverse member according to claim 2 wherein said transverse member comprises a combination channel and inverted T cross section.

9. A transverse member according to claim 2 wherein said transverse member comprises a triangular apex cross section.

10. A transverse member according to claim 1 wherein said transverse member comprises a variable cross section.

11. A railway car truck comprising: a pair of transversely spaced, longitudinally extending side frames; a pair of transversely extending axles having wheels integral therewith at opposite ends thereof for movement along a railway car track; each of said axles journalled in journal bearings respectively on opposite sides of said axles; said side frames being mounted for rocking movement relative to said journal bearings; said side frames each having mounted thereon at about the longitudinal midpoint thereof at least one side bearing for mounting a rail car body thereon adapted to receive substantially the entire weight of the car body, said side bearings having a bearing surface having a coefficient of friction sufficiently low to allow the car body to slide thereon as curves are traversed; a transverse member integrally affixed to each of said side frames, said side frames and said transverse member defining an H frame in plan; said transverse member having a cross section including a pair of spaced sides extending across said truck and a member joining said sides defining a hollow portion having an open bottom such that the shear center of said cross section is spaced upwardly from the neutral axis of said cross section throughout the length of said transverse member; said transverse member having torsional flexibility tending to allow the truck wheels to remain in engagement with the track when one wheel is displaced vertically with respect to the other wheels; said transverse member having a center bearing located at the mid portion thereof at about said shear center for receiving a cooperating car body center connection; said center bearing having sufficient vertical surface area to transmit horizontal loads radially between the car body and truck; said center bearing being spaced from said neutral axis a distance sufficient to prevent substantial torsional deflection of said transverse member.

12. A railway car truck comprising: a pair of transversely spaced longitudinally extending side frames; a pair of transversely extending axles having wheels integral therewith at opposite ends thereof for movement along a railway car track; each of said axles journalled in journal bearings respectively on opposite sides of said axles; said side frames being mounted for rocking movement on said journal bearings; each of said side frames having mounted thereon at about the midpoint thereof at least one side bearing for mounting a rail car body thereon adapted to receive the weight of the car body, said side bearing having a bearing surface having a coefficient of friction sufficiently low to allow the car body to slide thereon as curves are traversed and sufficiently high to at least partially damp oscillations of said truck relative to the car body; a transverse member integrally affixed to said side frames to define an H frame in plan, whereby substantial hunting of said truck is prevented at high speeds said transverse member having a cross section including a pair of spaced sides extending across said truck and a member joining said sides defining a hollow portion having an open bottom in which the shear center of said cross section is spaced upwardly from the neutral axis of said cross section throughout the length of said transverse member; said transverse member having torsional flexibility allowing the truck wheels to remain in engagement with the track when one wheel is displaced vertically with respect to the other wheels; said transverse member having a center bearing located at the mid portion thereof at about said shear center for receiving a cooperating car body center connection; said center bearing having sufficient vertical surface area to transmit horizontal loads radially between the car body and truck; said center bearing being spaced from said neutral axis a distance sufficient to prevent inducing substantial torsional deflection of said transverse member.

13. A railway car truck comprising: a pair of transversely spaced, longitudinally extending side frames; a pair of transversely extending axles having wheels integral therewith at opposite ends thereof for movement along a railway car track; said axles journalled in journal bearings respectively on opposite sides of the truck; said side frames being sprung from said journal bearings by means of resilient devices located adjacent said journal boxes; said side frames having mounted thereon at about the midpoint thereof at least one low friction side bearing adapted to take the weight of the car body and having a coefficient of friction sufficiently low to allow the car body to slide thereon as curves are traversed but sufficiently high to damp oscillations of the truck with respect to the car body; a transverse member integrally affixed to said side frames to define an integral H frame in plan; said transverse member having a cross section including a pair of spaced sides extending across said truck and a member joining said sides defining a hollow portion having an open bottom in which the shear center of said cross section is spaced upwardly from the neutral axis of said cross section throughout the length of said transverse member; said transverse member having torsional flexibility whereby the wheels tend to maintain engagement with the track when one wheel is displaced upwardly or downwardly with respect to the other wheels; a center bearing located at about the midpoint of said transverse member, at about said shear center; said center bearing having sufficient vertical surface area to transmit horizontal loads radially between the car and truck; said center bearing being spaced upwardly from said neutral axis sufficient to prevent inducing substantial torsional deflections into the transverse member; said resilient devices urging said side frames to a substantially neutral position; said resilient devices have affixed thereto damping devices acting to damp oscillations of said resilient devices; whereby rock and roll of said truck is controlled, and substantial hunting of said truck is prevented at high speeds.

* * * * *